United States Patent [19]

Chodorow

[11] Patent Number: 4,513,223

[45] Date of Patent: Apr. 23, 1985

[54] ELECTRON TUBE WITH TRANSVERSE CYCLOTRON INTERACTION

[75] Inventor: Marvin Chodorow, Stanford, Calif.

[73] Assignee: Varian Associates, Inc., Palo Alto, Calif.

[21] Appl. No.: 395,417

[22] Filed: Jul. 6, 1982

Related U.S. Application Data

[63] Continuation-in-part of Ser. No. 390,500, Jun. 21, 1982.

[51] Int. Cl.[3] ..... H01J 25/00

[52] U.S. Cl. ..... 315/4; 315/3; 315/5; 372/2

[58] Field of Search ..... 315/3, 4, 5; 372/2

[56] References Cited

U.S. PATENT DOCUMENTS

| | | | |
|---|---|---|---|
| 3,218,503 | 11/1965 | Adler | 315/3 |
| 3,296,484 | 1/1967 | Feinstein | 315/5 X |
| 3,398,376 | 8/1968 | Hirshfield | 315/5 |
| 4,199,709 | 4/1980 | Alirot et al. | 315/4 |
| 4,225,806 | 9/1980 | Lé Gardeur | 315/4 |
| 4,392,078 | 7/1983 | Noble et al. | 315/5 |
| 4,395,655 | 7/1983 | Wurthman | 315/4 |

FOREIGN PATENT DOCUMENTS

| | | | |
|---|---|---|---|
| 55-113240 | 9/1980 | Japan | 315/4 |

OTHER PUBLICATIONS

"The Peniotron" by Moats et al., A Fast Wave Device for Efficient High Power mm Wave Generator 1978 International Electron Device Meeting, Washington, D.C. (Dec. 4–6 1978).

*Primary Examiner*—Saxfield Chatmon

*Attorney, Agent, or Firm*—Stanley Z. Cole; Richard B. Nelson

[57] ABSTRACT

An electron-beam tube for generating high microwave power at high frequencies comprises a fast-wave circuit such as a hollow waveguide. The circuit wave has a component of electric field perpendicular to its propagation axis. This field interacts with motions of the electrons transverse to the axis, in particular cyclotron rotation in an axial magnetic field. The above features are common to the well-known "gyrotrons".

In the inventive tube the fast-wave circuit has means for locking a linearly polarized transverse-electric mode to the orientation of a circuit member such as the ridge in a ridged waveguide. The member (ridge) rotates spirally with distance along the guide. The added periodicity permits interaction with a space harmonic of the circuit wave. The −1 harmonic has a dispersion characteristic which provides beam-wave interaction over a wider frequency range than is possible in prior-art tubes of the gyrotron type.

26 Claims, 9 Drawing Figures

ELECTRON TUBE WITH TRANSVERSE CYCLOTRON INTERACTION

DESCRIPTION

This is a continuation-in-part of Application Ser. No. 390,500 filed June 21, 1982.

BACKGROUND OF THE INVENTION

Conventional electron tubes for generating microwaves, such as the traveling wave tube (TWT) and the klystron rely on axial motion of a beam of electrons interacting with axial components of the electric field of a wave-supporting structure. In the TWT the wave velocity must be equal to the electron velocity, so a periodic "slow wave" circuit must be used. For very high frequencies such as millimeter waves, the periodic pitch of the circuit becomes very small, thus hard to fabricate and capable of handling only low power. Also, the circuit diameter must be small compared to a wavelength, and must be close to the beam so that its usful fringing field can interact with the beam.

In the search for higher power at higher frequencies, several "fast wave" tubes have been proposed in which a non-periodic circuit such as a smooth waveguide is used to interact with periodic modulation of the electron beam. In a smooth hollow waveguide, of course, the axial phase velocity of the wave is always greater than the velocity of light so that the beam's axial velocity can never be synchronous with it. A two-conductor line in which the velocity is exactly equal to the velocity of light is also classed as a "fast wave" circuit. An electron would have to have infinite energy to be synchronous with it.

The most successful fast wave tube has been the "gyrotron" in which electrons in a beam are given spiraling cyclotron motions in an axial magnetic field. The electrons become bunched into certain phases of their cyclotron orbits by interacting with a transverse electric field in a smooth waveguide carrying a wave at or near its lower cutoff frequency. The gyrotron has been successful as an oscillator for extremely high power. It will be shown later that its bandwith is inherently small, so it would not be very useful as an amplifier for communications or the like.

Another tube employing cyclotron motion of electrons in a transverse field is described in U.S. Pat. No. 3,183,399 issued May 11, 1965 to Richard H. Pantell and assigned to the assignee of this application. In Pantell's tube a rectangular smooth waveguide is used, supporting a linearly polarized $TE_{01}$ wave. Pantell described the beam modulation as due to axial bunching of electrons into a spiral ribbon by velocities induced by the cyclotron motion cutting transverse magnetic field lines of the radio-frequency wave mode. Such bunching certainly may exist, although it now appears that Panell's tube probably operated with gyrotron bunching utilizing slightly relativistic electron motion. Pantell's tube was thus an early gyrotron, and would have a very narrow bandwidth. U.S. Pat. No. 3,249,792 issued May 3, 1966 to Richard H. Pantell describes a variation of the above-described tube which uses a two-wire transmission line instead of a hollow waveguide. The wave velocity is then just the speed of light for all frequencies. FIG. 3 of the latter Pantell patent is an omega-beta diagram from which it is clear that synchronous interaction can occur only at sharply limited frequencies.

SUMMARY OF THE INVENTION

An object of the invention is to provide an electron beam tube capable of high power output at high frequencies and also a wide bandwidth.

A further object is to provide a tube with an easily made fast-wave circuit.

A further object is to provide a tube in which the circuit and beam diameters are comparable to half a free-space wavelength.

These objects are attained by a tube in which a beam of electrons progresses in an axial direction while the electrons follow spiral paths due to their cyclotron rotation in an axial magnetic field. The circuit wave is a fast wave having a polarized transverse electric field component which interacts with the spiralling electron motion. To obtain bandwidth, the polarization of the wave is made to spiral with distance thru the circuit. This alters the apparent frequency of the wave as seen by the electrons such that synchronism with a constant-velocity electron beam is obtained over a wider range of frequencies.

BRIEF DESCRIPTION OF THE DRAWINGS

FIG. 3A is a schematic axial section of a tube embodying the invention.

FIG. 3B is a section perpendicular to the axis of the tube of FIG. 3A.

FIG. 6A is a schematic side view of another fast-wave circuit.

DESCRIPTION OF THE PREFERRED EMBODIMENTS

Figure 1:
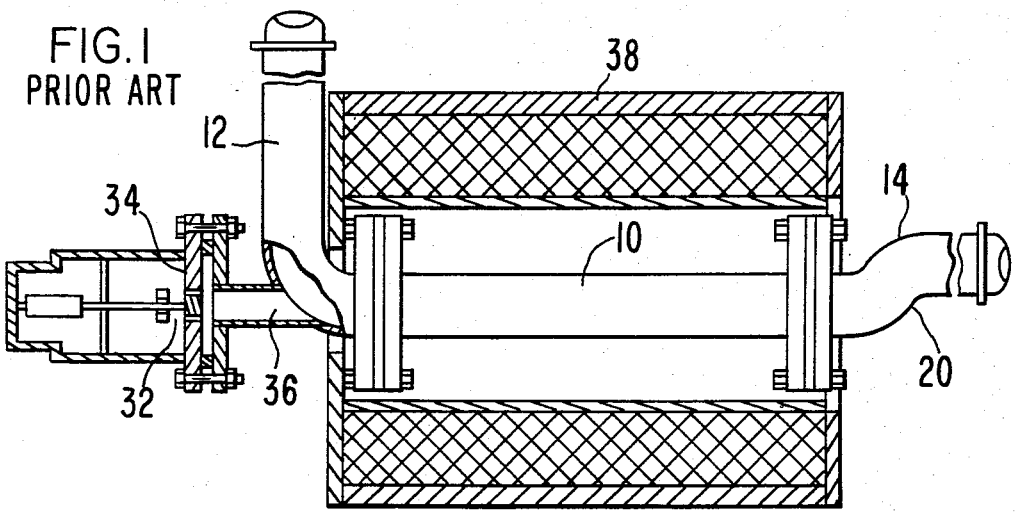
FIG. 1 PRIOR ART
FIG. 1 is a schematic axial section of a prior-art cyclotron-interaction tube.

FIG. 1 is taken from the above-mentioned prior-art U.S. Pat. No. 3,183,399 which is hereby incorporated by reference. FIG. 1 is a cross-section of the tube. A hollow beam of electrons is drawn from an annular thermionic cathode 32 by an anode 34 having an annular gap for passing the beam.

Across the annular anode gap is a radial magnetic field which produces transverse rotation of the electrons. The beam then traverses through an entrance tunnel 36 which is small enough to be cut off for the useful frequencies. The beam then passes through a section of rectangular waveguide 10 which is the beam-wave interaction circuit. The spent beam is collected on an offset wall 20 of waveguide 10. An input signal wave is fed in through a waveguide 12 and the amplified signal is removed from the downstream end via an output waveguide 14.

An axial magnetic field along interaction waveguide 10 is generated by a surrounding solenoid magnet 38.

As discussed above, Pantell described the interaction of the electrons and the wave as initiated by bunching the electrons by axial motion which is caused by their cyclotron orbits cutting transverse magnetic field lines of the radio-frequency wave. This would bunch the electrons into a ribbon in the shape of a spiral around the axis with a pitch equal to the guide wavelength. The ribbon as a whole would have a cyclotron rotation. The magnetic forces on the electrons used for bunching are of course much weaker than the forces on the electrons of the rf electric field. Current theoretical analyses suggest that the bunching in Pantell's tube was probably phase bunching in the cyclotron orbits, dependent on the relativistic changes in an electron's mass as it is accelerated or decelerated in its cyclotron orbit by the transverse component of the rf *electric* field. Such gyrotron bunching is described in the article "Cyclotron Resonance Devices" by R. S. Symons and H. R. Jory, published in the book "Advances in Electronics and Electron Physics", Vol. 55, Academic Press, Inc. This article is hereby incorporated by reference. As shown therein, the bunch forms at a phase of the cyclotron orbits where it will deliver its rotational energy to the component of rf electric field transverse to its axis of rotation.

Figure 2:
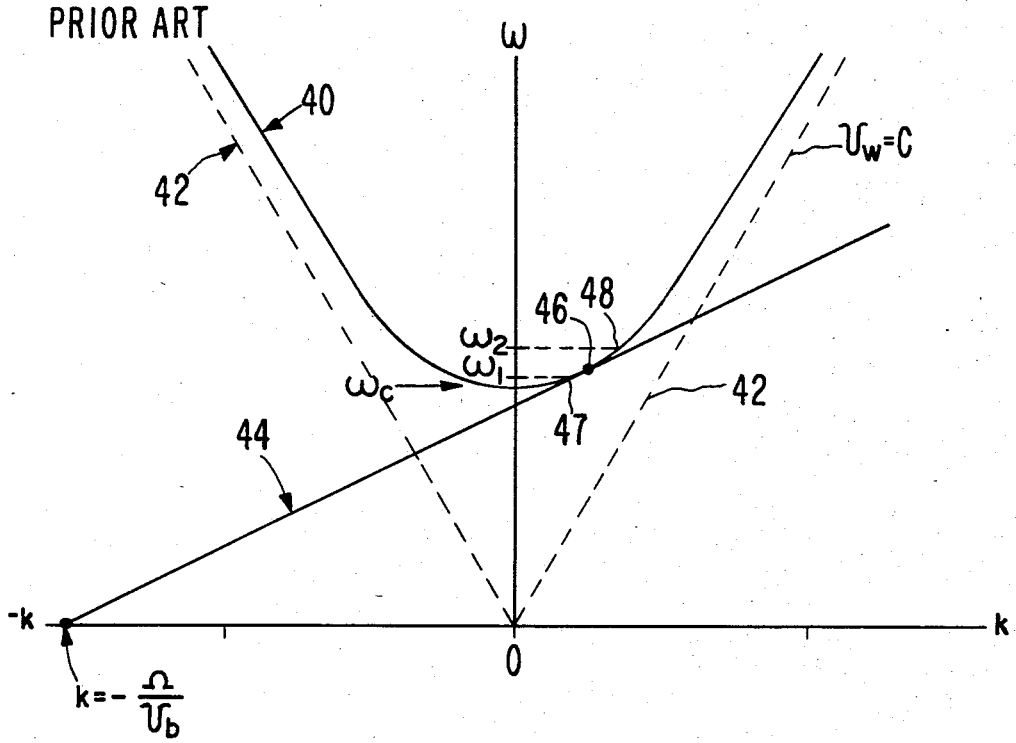
FIG. 2 PRIOR ART
FIG. 2 is a schematic omega-beta diagram of the prior-art tube of FIG. 1.

FIG. 2 is a schematic dispersion diagram of a fast-wave tube using a smooth waveguide such as Pantell's or the gyrotrons of the above-cited reference. Frequency $\omega$ is plotted vertically vs. wave number k plotted horizontally. The wave number k is used for a non-periodic circuit, while the equivalent axial propagation constant $\beta$ is commonly used in connection with periodic circuits. The dispersion curve 40 for smooth, hollow waveguide is a hyperbola crossing the k=o axis at the cutoff frequency $\omega_c$. For high frequencies, curve 40 approaches asymptotically to straight lines 42 having slopes equal to the velocity of light in vacuum. Straight line 44 is the locus of points for which the frequency of a wave as experienced by an axially moving electron is equal to the cyclotron frequency in the axial focusing magnetic field. This frequency may also be regarded as the wave frequency altered by the Doppler shift due to the axial electron velocity. The equation of line 44 is:

$$\omega - kvb = \Omega$$

where $vb$ is the axial drift velocity of the beam and $\Omega$ is the cyclotron frequency. Straight line 44 has a slope equal to the axial drift velocity $v_b$. It crosses the zero frequency line at $k = -\Omega/vb$. Synchronous interaction of the periodic beam and the waveguide wave occurs at or near frequencies where their dispersion curves 40,44 intersect or at least come close together. This is the point at which the radio frequency field seen by an electron moving at the axial velocity of the beam is just equal to the cyclotron frequency. The widest frequency band over which this occurs is obtained by adjusting the cyclotron frequency and the axial beam velocity so that beam curve 44 is tangent to waveguide curve 40 at a point 46. In practical gyrotrons the curves are very close over only a narrow range of frequencies between $\Omega_1$ and $\omega_2$ corresponding to points 47,48. Thus, the gyrotrons, tubes of Pantell's type, have only a narrow band of operating frequencies.

FIGS. 3A and 3B are schematic cross sections of a tube embodying the invention. An electron gun 50 is used to generate a hollow beam of electrons 56 which have rotatary motion transverse to their axial motion. Gun 50 is similar to that described in U.S. Pat. No. 3,258,626 issued June 28, 1966 to G. S. Kino and N. J. Taylor and assigned to the assignee of the present invention. It comprises a conical thermionic cathode 52 surrounded by a tapered conductive anode 54 held at a relatively positive potential by a power supply 58 whose voltage appears across a dielectric seal 60 which forms part of the vacuum envelope. The entire gun is immersed in a relatively constant axial magnetic field (not shown). Electrons drawn outward from cathode 52 cut the axial magnetic field lines and are given thereby a rotatory motion. They also acquire an axial velocity from the axial component of electric field between tapered cathode 52 and tapered anode 54. A solid electron-beam may also be used in the invention, using suitable magnetic means to give the electrons rotation transverse to the axis. Such a means is described in U.S. Pat. No. 3,398,376 issued Aug. 20, 1968 to J. L. Hirshfield. Beam 56 is then drawn into the main tube body 61, a metallic structure, held, in this example, at the potential of anode 54. In the entrance portion of body 61 the axial magnetic field strength may be increased to increase the transverse component of electron motion at the expense of axial velocity. In tubes of this type the transverse energy is the main source of output microwave energy. The transverse energy may be increased by other methods, such as a transverse magnetic field rotating in azimuth with an axial pitch equal to the cyclotron wavelength, as described in the above-cited Hirshfield patent.

Beam 56 then enters the waveguide section 64 where it interacts with the electromagnetic wave. Waveguide 64 comprises a hollow cylindrical conductor 62 with a pair of juxtaposed conductive ridges 66 projecting inwardly toward the axis. Its cross section perpendicular to the axis is just that of a common ridged waveguide. However, as will be explained later, the purpose and characteristics of ridges 66 are quite different from that of ordinary ridged guide, whose purpose is to increase the frequency bandwidth between competing modes.

An input microwave signal is introduced into the upstream end of waveguide 64 thru a coupling iris 70 from an input rectangular waveguide 72. It is amplified in waveguide 64 by interaction with beam 56 and removed at the downstream end by an output waveguide 72. Waveguide windows (not shown) seal the vacuum envelope ends of waveguides 72. Beam 56 passes thru an iris 67 small enough to be non-transmitting for the wave, and is collected on the inner surface of a hollow collector 68.

A principal innovation of the invention is that waveguide 64 is neither a smooth fast-wave structure as in the prior art, nor a periodic "loaded" waveguide slow-wave circuit as in the conventional traveling wave tube with axial beam bunching. The orientation of the ridges 66 in waveguide 64 rotates with axial distance. As in conventional uniform ridged guide, the ridges are thick enough and penetrate far enough to remove the mode degeneracy inherent in a smooth cylindrical guide. They capacitively load the mode with rf electric field going from one ridge to the other, making its cutoff frequency lower than that of the other transverse mode having electric field perpendicular to the plane of the ridges, and also lower than that of the unridged guide. Thus, at operating frequencies for the loaded mode, the transverse mode is below its own cutoff frequency and will not be excited. In the inventive tube, the ridges are large enough to carry the mode pattern of the loaded mode with them and cause the entire mode pattern to rotate with advancing axial distance. The spatial relationship between the mode pattern and the ridges thus does not change.

The axial pitch of the ridges also is important for locking the mode pattern to it. It appears that it should be longer than half of a waveguide wavelength to preserve the instantaneous cross section of mode pattern, but it should be of the order of magnitude of the guide wavelength to provide the benefits described hereafter. Also, it appears that the axial half-pitch should be greater than the distance between opposed tips of the two ridges.

Figure 4:
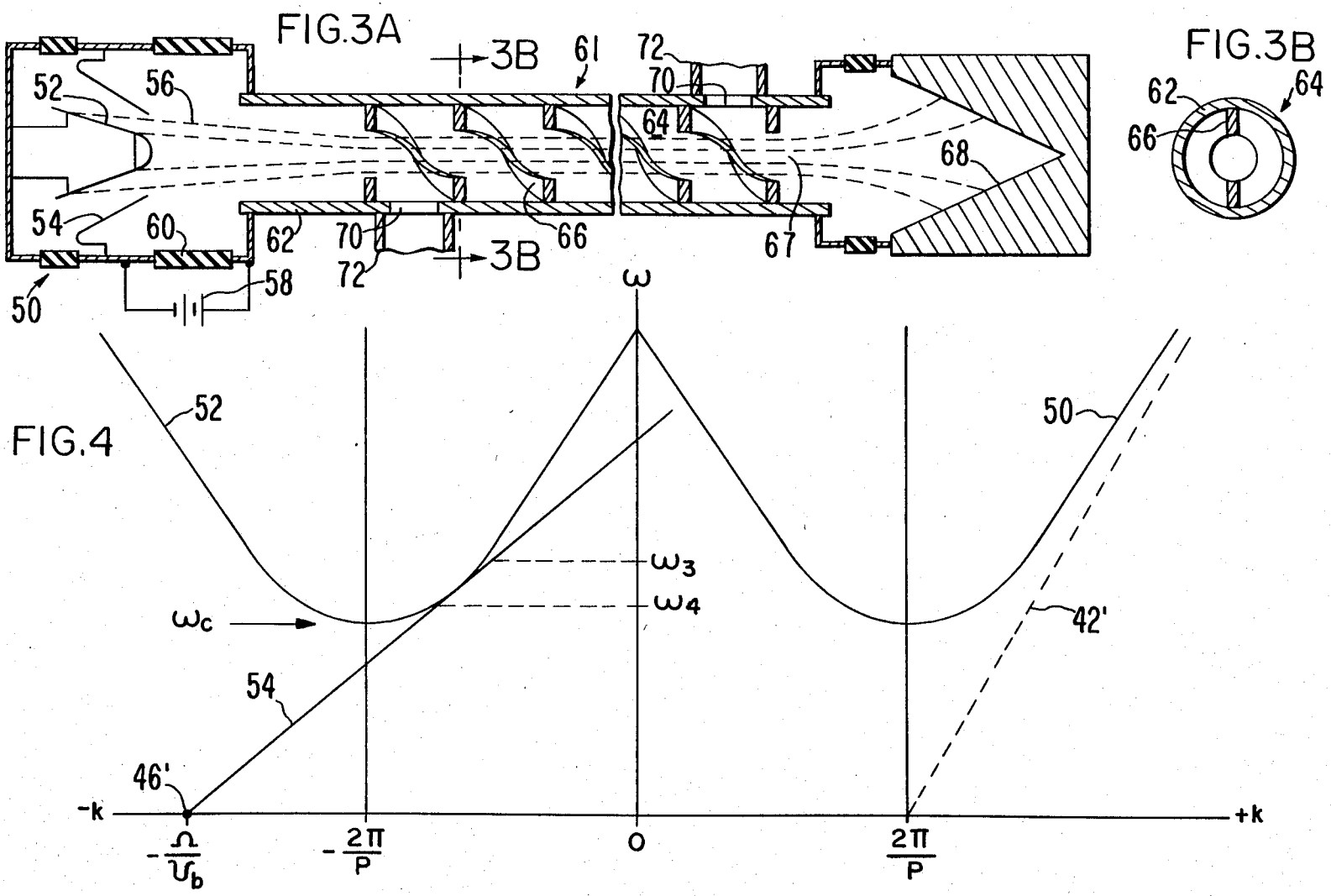
FIG. 4 is a schematic omega-beta diagram of the tube of FIG. 2.

A description of some benefits of the invention is illustrated by FIG. 4. This is a dispersion diagram of the same kind as FIG. 2, but for the waveguide of FIG. 3. In the smooth circuit of FIG. 2, at the waveguide cutoff frequency $\omega_c$, the guide wavelength becomes infinite and the wave number thus is zero. In FIG. 4 for the spiral circuit, we have plotted the wave numbers for the wave fields as seen by the electrons. These are the values that are important for the interaction. At the cutoff frequency $\omega_c$ the guide wavelength measured along a spiral ridge still becomes infinite. However, an electron traveling thru the tube sees the transverse field rotating in direction by 360 degrees or 2 radians for each complete pitch of the screwing ridges. The electrons thus see a periodic field for which the dispersion diagram 50 has been moved to center at $k=2(\pi/P)$ where P is the pitch of the screw. This is a periodic field and is comprised of space harmonics. The important space harmonic is the one whose dispersion curve 52 is centered at $k=-2(\pi/P)$. This curve is the same shape as curve 40 of FIG. 2, but displaced to the left. It is closer to the terminus 46' of the electron beam dispersion curve 54, representing a higher velocity beam, which is needed to bring straight line 54 to tangency with waveguide hyperbola 52. The important effect is that the steeper sloped part of hyperbola 52 occurs farther from the origin at $\omega_c$ and the rate of change of slope is considerably less. Thus the two curves remain very close together over an increased range of frequencies from $\omega_3$ to $\omega_4$. The bandwidth of the tube is greatly expanded.

Figure 5B:
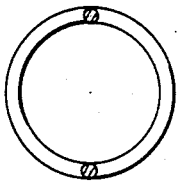
FIG. 5B is a sectional view of the circuit of FIG. 5A.
Figure 5A:
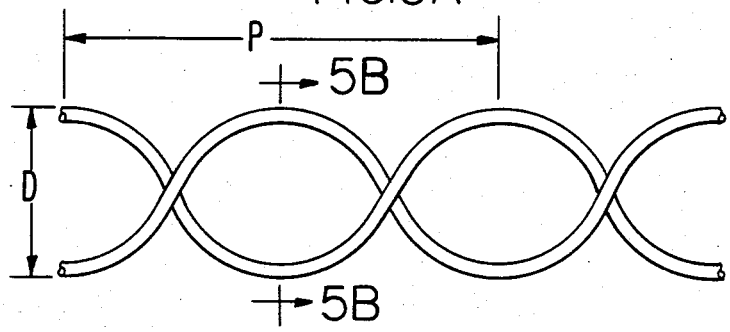
FIG. 5A is a schematic side view of an alternative fast-wave circuit usable in the invention.

FIGS. 5A and 5B illustrate an alternative embodiment of the invention wherein the waveguide comprises a bifilar helix of mutually insulated conductors. In a tube the two helices would be connected to have their currents in opposite phase at any cross-section. The mode pattern is essentially the same as for the ridged waveguide of FIGS. 3A and 3B. The bifilar helix is not a bandpass circuit but will transmit down to zero frequency. It therefore has the possibility of extremely wide bandwidth. However, removing heat from insulated conductors is difficult, so the power-handling ability of this circuit is limited compared to the ridged waveguide.

Bifilar helices have been used in 0-type traveling wave tubes. For that application it is the axial component of rf field which is useful, so the pitch of the helices is small compared to their diameter. In the present application it is the transverse electric field which is useful, so the pitch P is at least comparable to the diameter D.

Figure 6B:
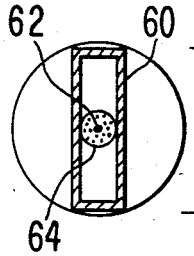
FIG. 6B is a section perpendicular to the axis of the circuit of FIG. 6A.
Figure 6B:
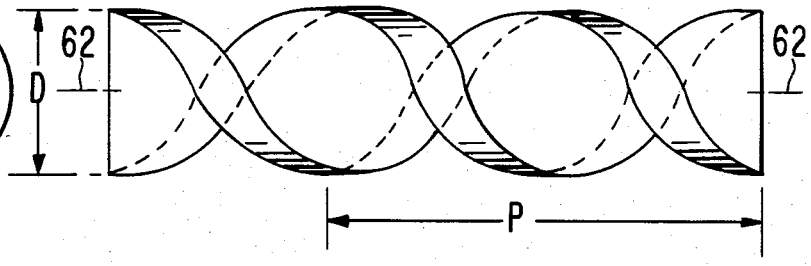

FIG. 6A is a side view and FIG. 6B an end view of yet another fast-wave circuit which may be used with the invention. This is a conventional rectangular waveguide 60 which is twisted into a spiral about its axis 62. The electron beam 64 may be a solid pencil as shown or it may be a hollow beam as shown in FIGS. 3A and 3B. The structure of FIGS. 6A and 6B has excellent power handling capability. It may be used with a larger beam than the ridged waveguide of FIG. 3 because the area of essentially uniform electric field is larger.

Of course, still other shapes of spiral waveguide may be used, such as a single-ridged guide with cylindrical or rectangular outline, double ridged rectangular guide, etc.

With any of the circuits shown above, however, an important advantage of the invention is that it uses the main transverse electric field of the wave rather than the fringing fields of periodic circuits as used in conventional TWTs. The fringing fields fall off exponentially with distance from the periodic circuits so the circuits must be quite small compared to the wavelength and the beam must be quite close to the circuit. In the present invention, on the other hand, the circuit cross section may be a sizeable fraction of a wavelength, and the beam will experience essentially the full field over a large part of the circuit cross section. Thus, the requirements for high power, especially at millimeter wavelengths, are met.

The above-described embodiments are intended to be exemplary and not limiting. Many other embodiments will become obvious to those skilled in the art. For example, the waveguide shape may not be rotated smoothly and continuously, but be rotated in discrete steps. Also, some discrete, wave-loading discontinuities in the guide such as capacitive or inductive posts or vanes may be put in sequentially rotated positions. The invention is to be limited only by the following claims and their legal equivalents.

I claim:

1. An electron tube comprising:

gun means for generating a beam of electrons having a velocity component along an axis, means for generating velocity of said electrons transverse to said axis, waveguide means for propagating an electromagnetic wave in the direction of said axis in energy-exchanging relation with said transverse velocity of said electrons, means for generating a magnetic field parallel to said axis, means for collecting said electrons after said beam emerges from said waveguide means, means for extracting electromagnetic energy from said waveguide means, said waveguide means having a cross-sectional configuration perpendicular to said axis which configuration rotates with distance along said axis, said configuration and rotation being such that the orientation of the polarization of a transverse electric field component of a desired wave mode is locked in the same spatial relationship to said cross-sectional configuration everywhere along said waveguide.

2. The tube of claim 1 wherein said beam is symmetrical about said axis before interacting with said wave.

3. The tube of claim 2 wherein said beam has a hollow annular cross section.

4. The tube of claim 1 wherein said means for generating transverse velocity comprises a magnetron injection structure of said gun.

5. The tube of claim 1 wherein the cyclotron frequency of said electrons in said axial magnetic field is approximately equal to said wave frequency as Doppler shifted by the axial component of beam velocity.

6. The tube of claim 1 wherein said waveguide means comprises a bifilar helix.

7. The tube of claim 1 wherein said waveguide means comprises a ridge-loaded waveguide.

8. The tube of claim 7 wherein said waveguide comprises a circular cylindrical hollow tube with an inward-protruding conductive ridge which spirals with distance along said axis.

9. The tube of claim 8 wherein said waveguide comprises a pair of said inward-protruding ridges arrayed symmetrically opposite each other.

10. The tube of claim 1 further comprising means for injecting a signal wave at one end of said waveguide whereby said tube may operate as an amplifier.

11. The tube of claim 1 wherein the pitch of said rotation of said cross sectional shape is greater than the diameter of said beam.

12. The tube of claim 1 wherein the pitch of said rotation of said cross sectional shape is greater than the guide-wavelength of said wave.

13. The tube of claim 1 wherein said cross sectional shape comprises a series of discrete, wave-loading discontinuities whose orientations rotate progressively with distance along said axis.

14. In a gyrotron-type tube defining an axis and supporting an electron beam in which electrons exhibit a velocity transverse to said axis, said tube having waveguide means for propagating an electromagnetic wave along said axis in energy exchanging relation with said transverse velocity of said electrons, the improvement in which said waveguide means defines an internal cross-sectional configuration rotating with distance along said axis, whereby the polarization of a transverse electric field component of a desired mode of said wave rotates with distance along said axis in accordance with the rotation of said configuration.

15. The tube of claim 14 in which said cross-sectional configuration includes a portion protruding inwardly in a direction transverse to said axis.

16. The tube of claim 15 in which said inwardly protruding portion rotates with said distance along said axis.

17. The tube of claim 16 in which said inwardly protruding portion is discontinuous in the axial direction.

18. The tube of claim 15 in which said portion rotates with axial distance with a pitch greater than half of the waveguide wavelength.

19. The tube of claim 15 in which said cross-sectional configuration defines one or more pairs of opposed portions, each pair being azimuthally symmetrically positioned with respect to any other pair.

20. The tube of claim 14 in which said waveguide means includes a circular cylindrical hollow tube with at least one pair of inwardly protruding opposed conductive protrusions rotating with distance along said axis.

21. The tube of claim 20 in which one-half of the pitch of rotation of said protrusions is greater than the distance between opposed ones of pair of said conductive protrusions.

22. The tube of claim 14 further comprising means for injecting a signal wave to be amplified at the upstream end of said waveguide means.

23. An electron tube comprising:

means for generating a beam of electrons having both a velocity component along an axis and a velocity component transverse to said axis, waveguide means for propagating an electromagnetic wave in the direction of said axis in energy-exchanging relation with said transverse velocity component of said electrons, means for generating a magnetic field parallel to said axis, means for collecting said electrons after said beam emerges from said waveguide means, means for extracting electromagnetic energy from said waveguide means, an internal inwardly-protruding member included in said waveguide, said member having a cross-sectional shape perpendicular to said axis such that the polarization of a transverse electric field component of a desired wave mode is locked to the azimuthal position of said member, the azimuthal position of said member being rotated with increasing distance along the axis with said locking of said transverse field component to said member being preserved everywhere along said axis.

24. A tube as in claim 23 in which said inwardly protruding member comprises a rectangular waveguide twisted into a spiral about said axis.

25. A tube as in claim 23 in which said inwardly protruding member includes at least two opposed conductive ridges spiraling with distance along said axis.

26. A tube as in claim 23 in which said inwardly protruding member comprises a bifilar helix.

* * * * *